United States Patent [19]

Jones

[11] Patent Number: 4,648,862

[45] Date of Patent: Mar. 10, 1987

[54] MACHINE FOR MAKING PAPER BOOKLETS

[75] Inventor: Stanley G. Jones, Mid-Glamorgan, Wales

[73] Assignee: Rizla Limited, Mid-Glamorgan, Wales

[21] Appl. No.: 745,128

[22] Filed: Jun. 17, 1985

[30] Foreign Application Priority Data

Jun. 20, 1984 [GB] United Kingdom ..... 8415758

[51] Int. Cl.[4] ..... B31D 5/00

[52] U.S. Cl. ..... 493/346; 83/320; 83/357; 83/369

[58] Field of Search ..... 83/320, 319, 318; 493/357, 390, 65, 289, 369, 346

[56] References Cited

U.S. PATENT DOCUMENTS

| | | | |
|---|---|---|---|
| 2,414,906 | 1/1947 | Seltzer | 83/320 X |
| 3,686,989 | 8/1972 | Dreher | 83/320 |
| 4,290,592 | 9/1981 | Kastner | 83/320 |
| 4,361,064 | 11/1982 | Sasaki | 83/319 |

FOREIGN PATENT DOCUMENTS

| | | |
|---|---|---|
| 427701 | 4/1926 | Fed. Rep. of Germany . |
| 2448541 | 4/1975 | Fed. Rep. of Germany . |
| 2008282 | 5/1979 | United Kingdom . |
| 2065080 | 8/1983 | United Kingdom . |

*Primary Examiner*—James F. Coan

*Attorney, Agent, or Firm*—Marks Murase & White

[57] ABSTRACT

Apparatus is provided in which booklets of interleaved cigarette papers can be made from continuously moving strands of strip paper in which a cutting knife used to sever the paper strips precisely follows movement of the strip. Movement of a driven input shaft is brought onto the moving platform and used to operate the cutting knife. Paper from bobbins is converged by formers and a spreader into a strand advanced by nip rolls through a cutting station. The knife in the station cuts a booklet from the strand while the station moves with the strand. A driven rotatory shaft of non-circular section transmits its rotation to a sleeve that slides therealong as the station reciprocates relative to a shaft. The sleeve is operably connected e.g. by gearing or by a cam and follower to the knife so that rotation thereof brings about the cutting movement.

26 Claims, 13 Drawing Figures

MACHINE FOR MAKING PAPER BOOKLETS

FIELD OF THE INVENTION

This invention relates to a machine for making paper booklets which is particularly, though not exclusively, intended for making booklets of interleaved cigarette paper.

BACKGROUND OF THE INVENTION

It is known from Patent Specification No. GB-A-688144 (Korber) to make booklets of folded and zig-zag interleaved cigarette papers by withdrawing paper strip from a plurality of supply rolls or bobbins, folding and interleaving the strips by passage through a succession of combs to form a folded and interleaved strand, and cutting the strand to form booklets. But the machine employed by Korber had a stationary cutting knife which was impractical for high speed operation and did not make a clean transverse cut through the strand which is required to move continuously. U.K. Pat. No. 2165080 (Kastner) describes a similar machine in which the knife is mounted on a movable knife plate carried by a platform that is reciprocally movable in a direction parallel to the direction of travel of the strand of interleaved paper strips. A cylinder or other means carried by the platform reciprocally moves the knife plate towards or away from the strand so that the knife follows the movement of the strand as it severs the strip. A pusher plate carried by and movable with the knife plate displaces a severed booklet or packet sideways with respect to the line of travel of the strand. But the Kastner machine still presents a number of disadvantages. Reciprocation of the platform is by an eccentric on a drive wheel that is coupled to the platform by a pivoted link, so that the platform does not match the speed of the strand throughout its rearward stroke, but instead its velocity varies in simple harmonic motion. Since the knife is moved towards and away from the strand without any component of motion across it, cutting is not as efficient as it could be. Cut booklets are discharged sideways into a magazine which is joined to the reciprocating platform by means of a flexible portion, which is essential because movement of the pusher is not separated from that of the knife.

SUMMARY OF THE INVENTION

It is an object of the invention to provide apparatus for forming booklets from continuously moving strands of paper strips in which the cutting knife precisely follows the movement of the strip, provision can be made for clamping the strand before it is cut and for ejecting the cut booklets, and the clamping, cutting and ejection operations may be timed independently in accordance with the position of the knife to bring about the desired results.

The solution adopted by the applicants is to bring the rotatory movement onto the moving "platform" or cutting station and to use the movement to operate the cutting knife. Thus rotation of a driven member in the cutting station may be transmitted to the knife by means of a cam and follower, by means of gearing or by means of a chain or belt. The knife can be driven positively from the same drive that reciprocates the cutting station, and the desirable guillotine-like cutting action may be achieved.

Broadly stated the invention provides a machine for performing an operation on a paper strand including means for forming leaves of paper into a strand, a station in the path of the strand, means in the station for performing an operation on the strand, drive means for continuously advancing the strand through the station and for reciprocating the station along the strand so that a booklet length of the strand enters the station while the station moves counter to the strand, and drive transfer means operatively connecting said drive means to the means in the station so that the operation is performed while the station moves with the strand.

More specifically the invention provides a machine for forming booklets of paper comprising:

a paper supply in the form of a plurality of rolls of strip paper from which a strip may be continuously withdrawn;

means for converging paper strips withdrawn from the several supply rolls to form a single strand;

means for advancing the strand;

a cutting station through which the strand is advanced and supported for reciprocal movement along the strand so that a booklet length of the strand enters the station while the station moves counter to the strand;

a knife in the cutting station arranged to cut a booklet from the strand in the station while the station moves with the strand; and a rotating shaft of non-circular cross-section that passes through the station and through a sleeve therein that slides along the shaft as the station reciprocates and is rotated by the shaft, the sleeve being operably connected to the knife so that rotation thereof brings about the cutting movement.

DESCRIPTION OF PREFERRED FEATURES

The rolls of paper may be supported in a crescent shaped single unit bobbin stand or frame including posts to either side of each roll by means of stub axles on the bobbin carriers that are received in slots in the posts. Desirably the posts between adjacent rolls are common and the slots for the axles of different rolls are at different levels whereby the axles do not interfere with one another and one roll may be changed without disturbing the adjacent roll or rolls. The rolls may be arranged in upper and lower banks and the paper strips may be fed to converging means over guide rollers that deflect them to a generally horizontal line of travel.

The converging means preferably comprises a primary folding comb adjacent the rolls that folds the strips, a spreader comb that facilitates the first stage of interleaving, a secondary folding comb that substantially defines the interfolded shaped of the strips, and a final forming comb that determines the height of the interleaved strand.

BRIEF DESCRIPTION OF THE DRAWINGS

Embodiment of the invention will now be described with reference to the accompanying drawings, in which.

DETAILED DESCRIPTION OF PREFERRED EMBODIMENTS

Figure 2:
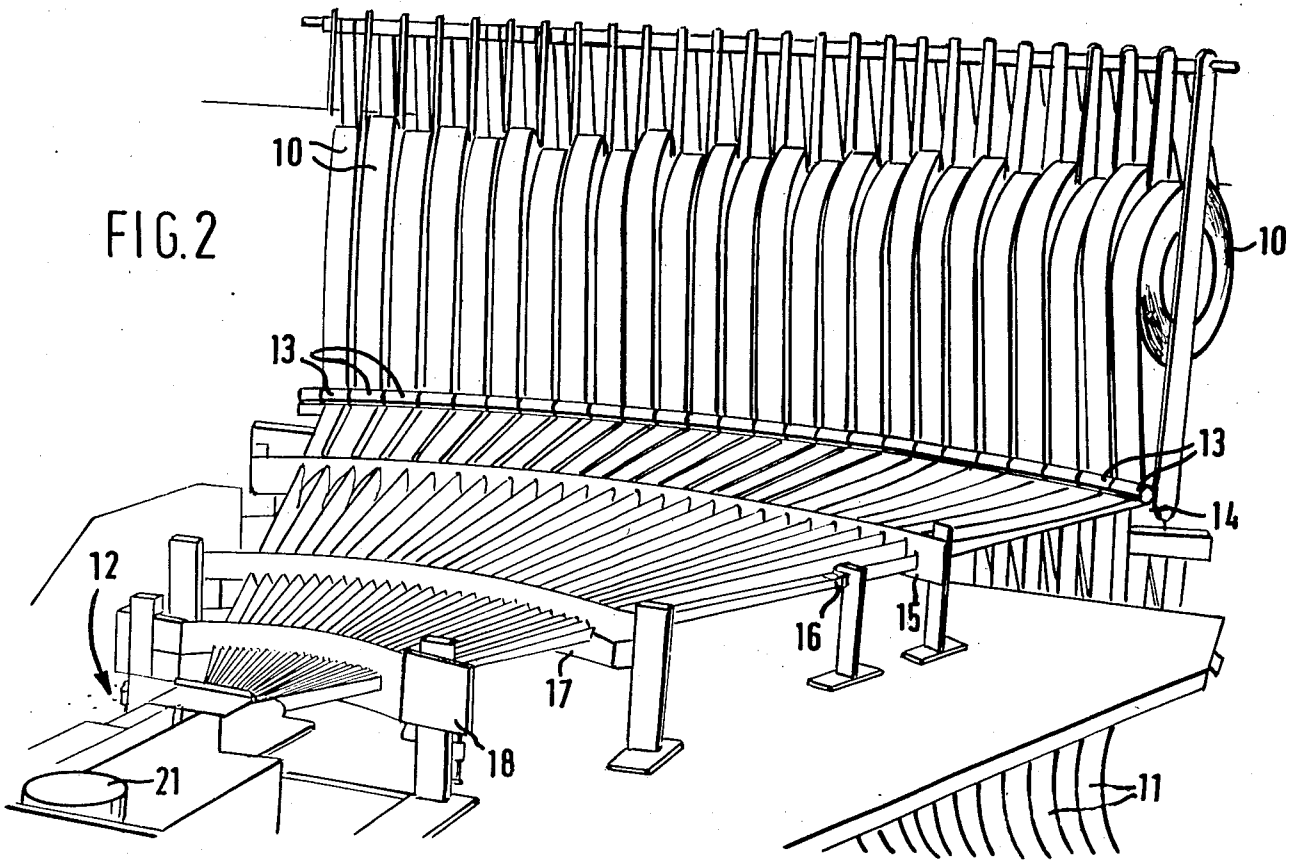
FIG. 2 is a view of the bobbin holder and interfolding part of the machine of FIG. 1.

In the drawings, there is shown a machine for folding and interleaving fifty sheets of cigarette paper into a so-called booklet, each booklet being separated from adjacent booklets by a strip of cardboard or similar separating material. There are therefore fifty paper strips and a single cardboard strip that have to be fed into the machine from the same number of bobbins. Referring to FIG. 2, these bobbins 10, 11 are arranged in two arcuate rows one above the other and in such a manner that the bobbins 10 in the upper row are in staggered relation to the bobbins 11 in the lower row. The arcs of the bobbins 10, 11 are struck from a centre coinciding with the point of convergence of the eventual interleaved paper strip as they enter a drive and cutting unit generally indicated by the reference numeral 12. The paper leaving bobbins 10, 11 are deflected into a generally horizontal path by upper and lower sets of guide rollers 13, 14 and passed to a first former 15 that is arcuate in plan with its centre coinciding with that of the bobbin arc which folds the several strips. The strips pass from the former 15 to a spreading comb 16 that is also arcuate in plan, the purpose of the spreading comb being to spread out and align the folded strips in order to facilitate the first step of interleaving. The paper passes from comb 16 to a second former 17 which substantially defines the interfolded shape of the sheets and thence to a final former 18 that serves to bring the interleaving to is final stage and to determine the height of the interleaved booklets. From the former 18 the interleaved strips converge at the inlet to a pair of parallel guides 19, 20 (shown in FIG. 3) defining a channel along which the resulting interleaved strand is conveyed and at which the leaves are compressed to form a flat strand for cutting into booklets.

The interleaved booklet strand from the guide channel passes between a pair of knurled drive or pull-through rollers 21, 22 both of which are driven through gearing (described below) at a proper surface speed. The roller 22 is reciprocable transversely and is spring loaded into engagement with the advancing strand. The purpose of this arrangement is to maintain a proper pressure on the strand and to compensate for any variation in paper thickness. The spring loading enables even a single leaf of paper to be pinched and pulled through, thus simplifying thread up of the complete machine. In earlier machines where the drive or pull through rollers had fixed centres, these were not effective until all the leaves were present between the rollers. It is important that positive drive on the booklet strand should be maintained and that no slippage between the strand and the rollers 21, 22 should occur, otherwise there will be an irregularity in the length of the cut booklets. The booklet strand leaving the rollers 20, 21 passes through a further pair of parallel guides 23, 24 which maintain the strand in its compressed state and stop the advancing strand from buckling.

Figure 3:
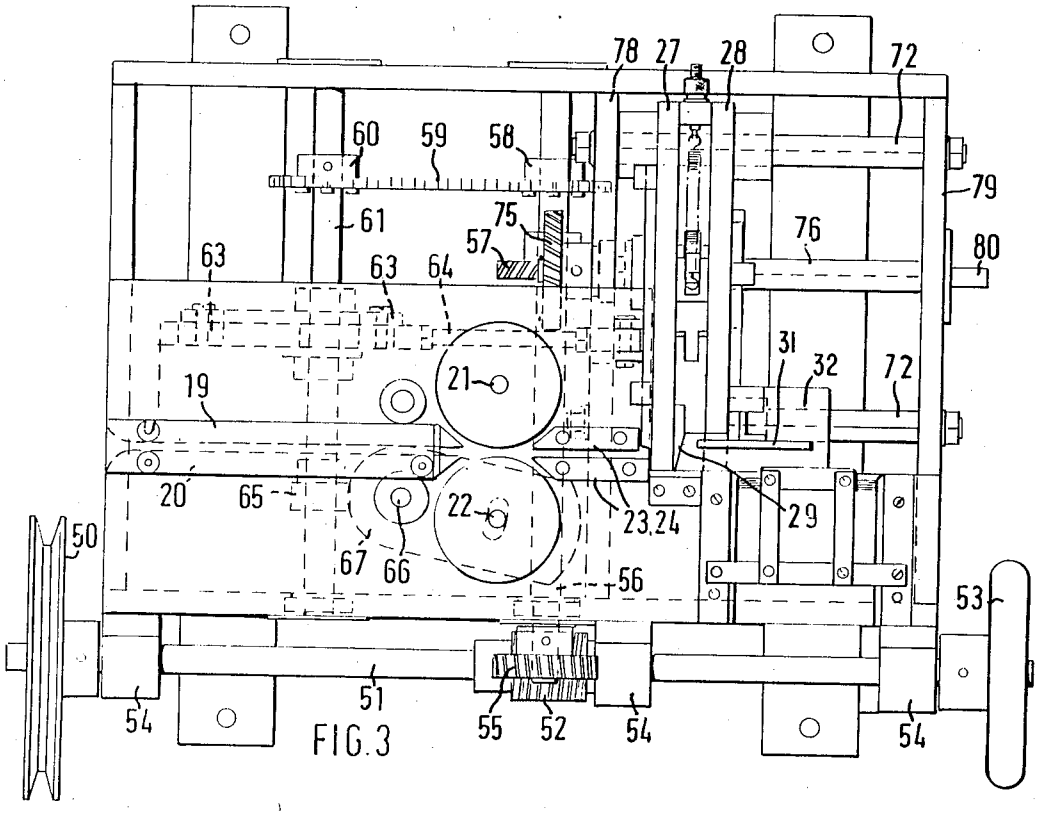
FIGS. 3, 4 and 5 are plan, side elevation and fragmentary perspective views of a drive and cutting units forming part of the machine of FIG. 1.
Figure 9:
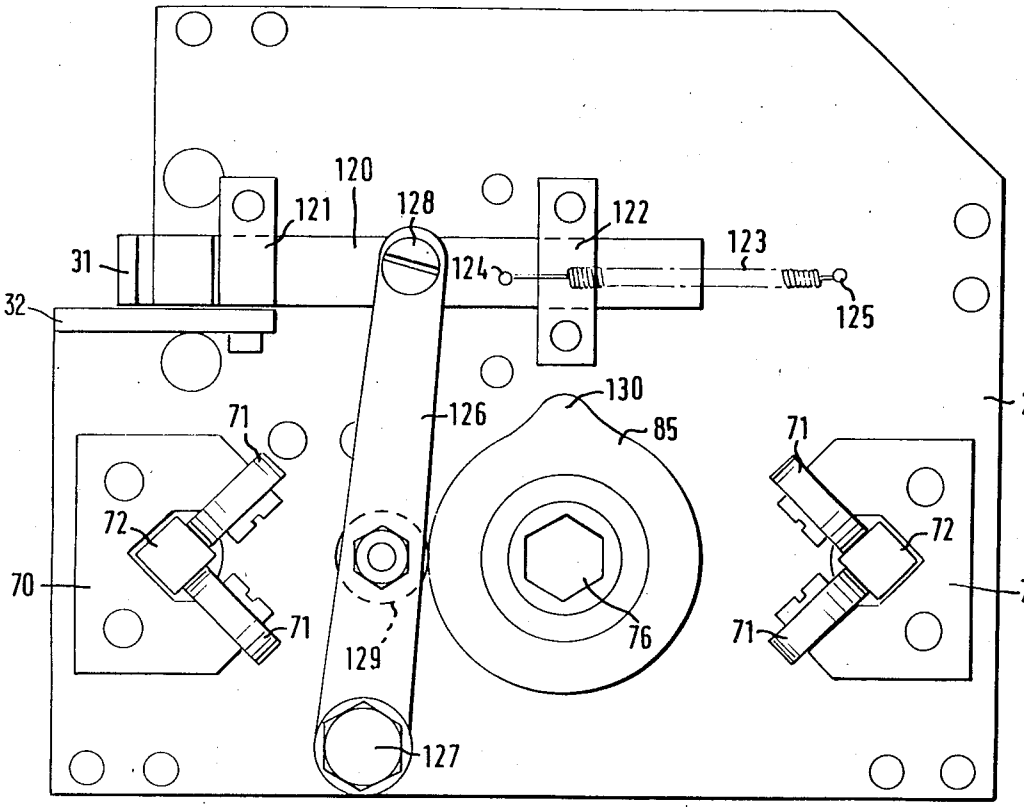
FIG. 9 is a view on the trailing or downstream outer face of the cutting unit showing a cut booklet ejector mechanism.

The strand then enters a cutting unit 25 through an aperture 26 in a leading plate 27 which is closed off by means of a high calibre steel fixed die 30. The unit has a trailing plate 28 that is mounted in closely spaced parallel relationship to the plate 27. A knife 29 located between the plates 27, 28 has its cutting surface against the inner face of the die 30 and is mounted for shearing movement across the aperture 26 and back to sever booklets from the advancing booklet strand. The cutting unit 25 is mounted on linear bearings and is reciprocated by means of a constant velocity cam and follower arrangement so as to move upstream and downstream of the paper strand at the same speed as the paper strand advances. The upstream face of the leading plate 27 has a cam operated paper clamping mechanism. Thus the strand enters the aperture 26 while the unit 25 is moving upstream of the strand with the clamping mechanism in a disengaged position and with the knife 29 also retracted. The travel of the carriage 25 is, of course, half the length of a cut booklet. After the carriage return is complete, the clamping mechanism closes to hold the booklet strand against the die 30 and during the forward stroke the knife 29 is advanced in appropriately timed relationship to sever a booklet length from the strand. The downstream face of the plate carries a pusher mechanism 31 operated by a cam to eject the cut booklet at the downstream extremity of the travel of the unit 25. The cut booklets rest atop a table 32 shown in FIGS. 3 and 9. Referring to FIG. 3, the table 32 is positioned above shaft 72 and below pusher mechanism 31. In FIG. 9, the table 32 is shown in elevation. The cut booklets are ejected by the pusher mechanism 31 in a plane normal to the line of advance of the booklet strand onto an endless belt conveyor 32 bounded by upstanding guides 33, 34, as shown in FIG. 9, to hold the cut booklets in position thereon. An indexing mechanism 35 advances the conveyor 32 in booklet thickness increments so that newly cut booklets are accepted onto the conveyor 32 at the proper time. A retention bar 36 loaded by leaf springs 37 engages the edge of the last cut booklet as the cutting unit 25 returns so that the advance of the booklet strand into the cutting unit at the next stroke is not impeded by unwanted return of the last cut booklet or part thereof from the conveyor.

Figure 1:
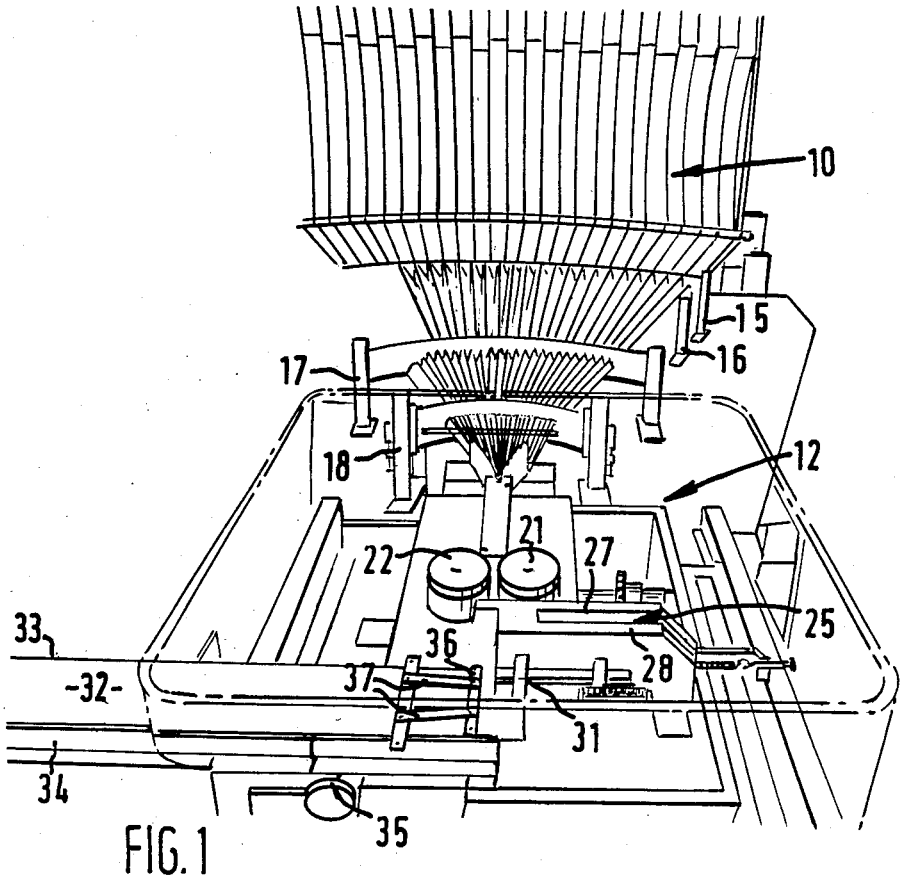
FIG. 1 is an end view of a folding and interleaving machine according to the invention.
Figure 6:
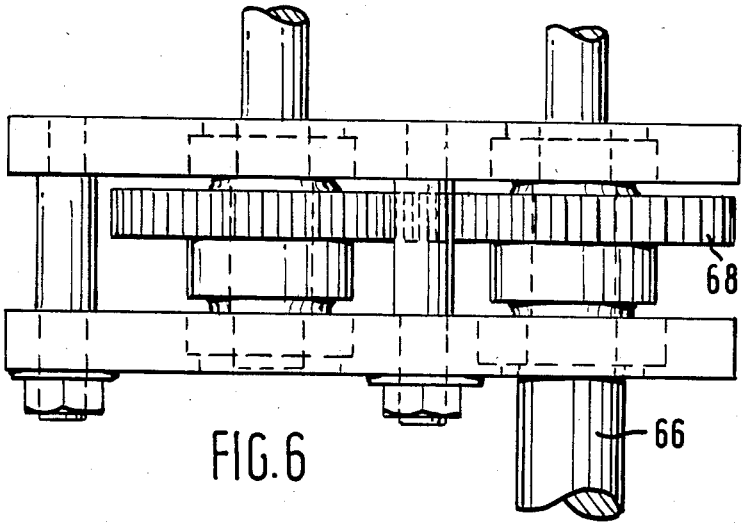
FIG. 6 is a view of a drive unit for pull-through rollers that is in turn driven from the drive unit of FIG. 3.
Figure 4:
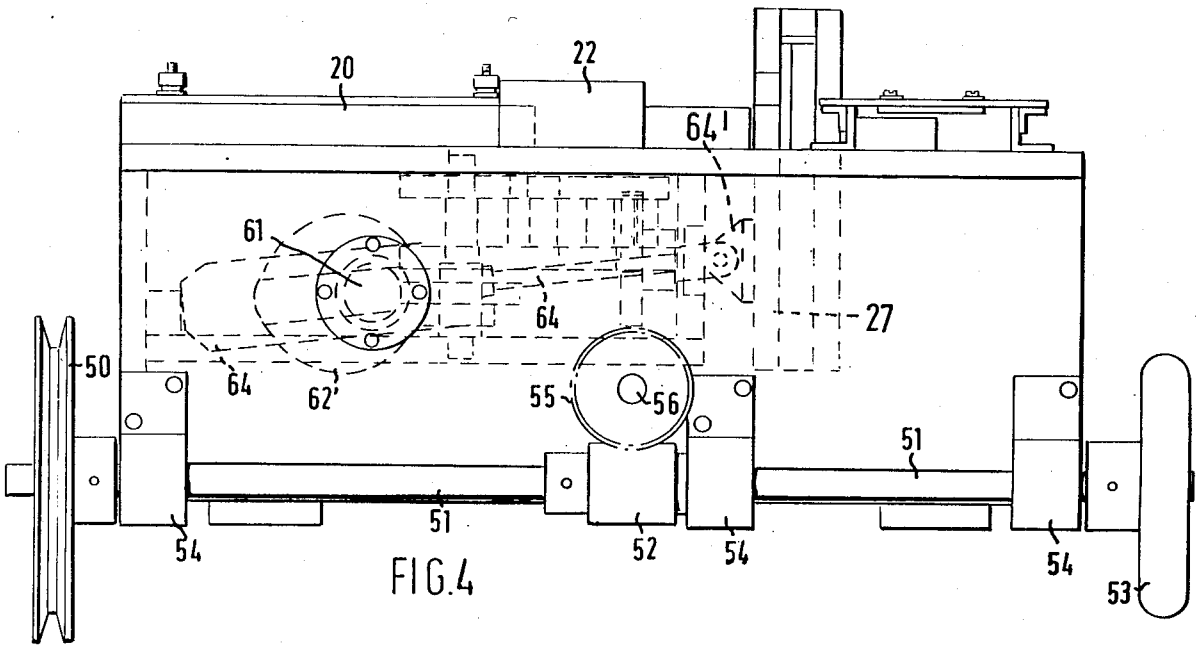
Figure 5:
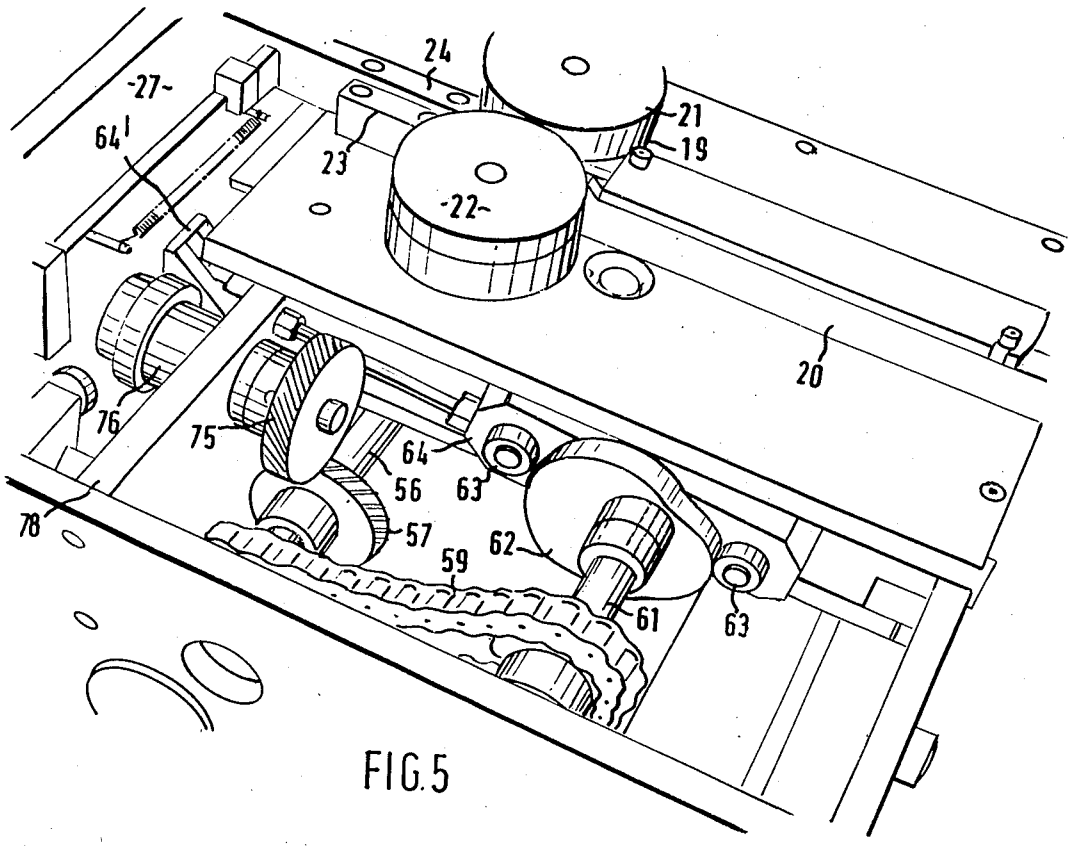

A general arrangement of the drive unit is shown in FIGS. 3, 4 and 5. Power from a drive belt of an electric motor is transmitted via pulley wheel 50 to drive input shaft 51 that carries a worm 52 and a hand wheel 53, the shaft being supported for rotation in bearings 54. The worm 52 meshes with worm wheel 55 of a transverse shaft 56. The shaft 56 carries a helical gear 57 and a sprocket wheel 58. A chain 59 connects the sprocket wheel 58 with a further sprocket wheel 60 of a second transverse shaft 61 that drives the constant velocity cam and the pull-through rollers 21, 22. Attached to the shaft 61 is a generally heart-shaped cam 62 that provides a uniform motion to a follower assembly including a pair of follower rollers 63 that engage opposite sides of cam 62 and are carried in a uniform cam link 64 that is pivotally connected at 64' to the leading plate 27 of the cutting unit 25. The shaft 61 also carries a helical gear 65 that drives a vertical shaft 66 by means of a helical gear 67. At the upper end of shaft 66 is a straight spur gear 68 (FIG. 6) which in turn drives the two pull-through rollers 21, 22 by a series of interlocking gears.

Figure 8:
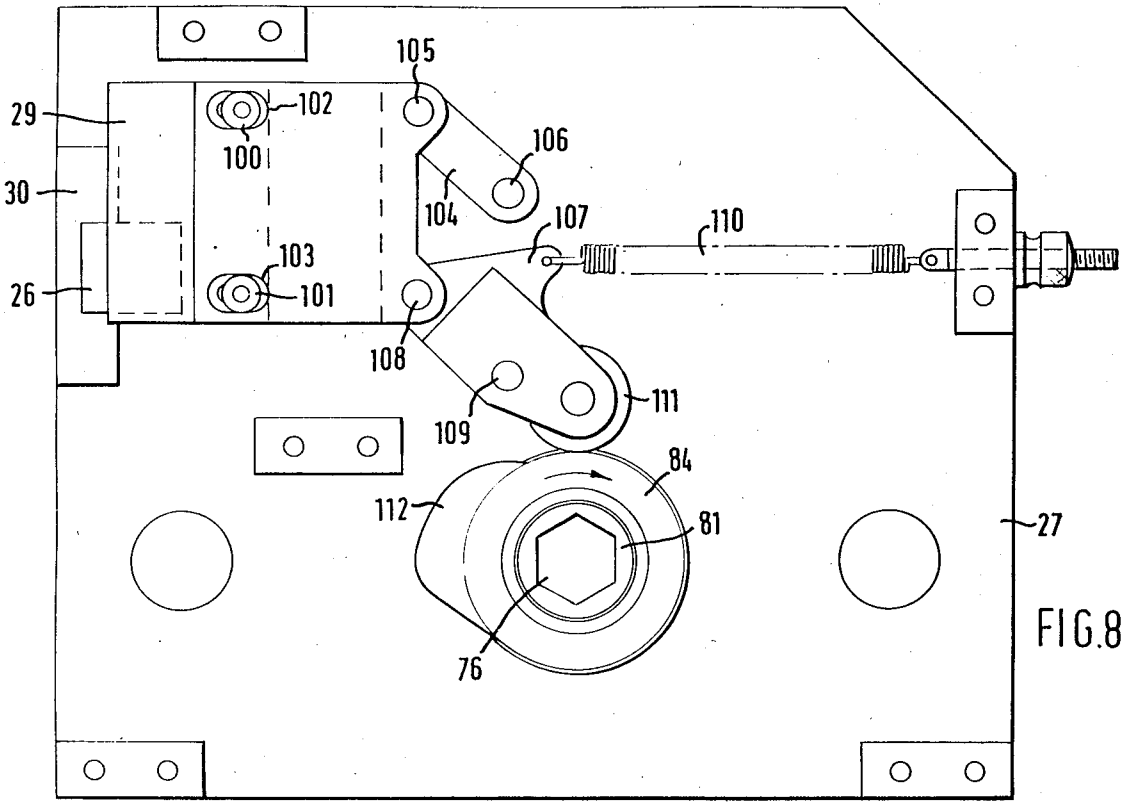
FIG. 8 is a view on the leading inner face of the cutting unit showing one knife mechanism.
Figure 10:
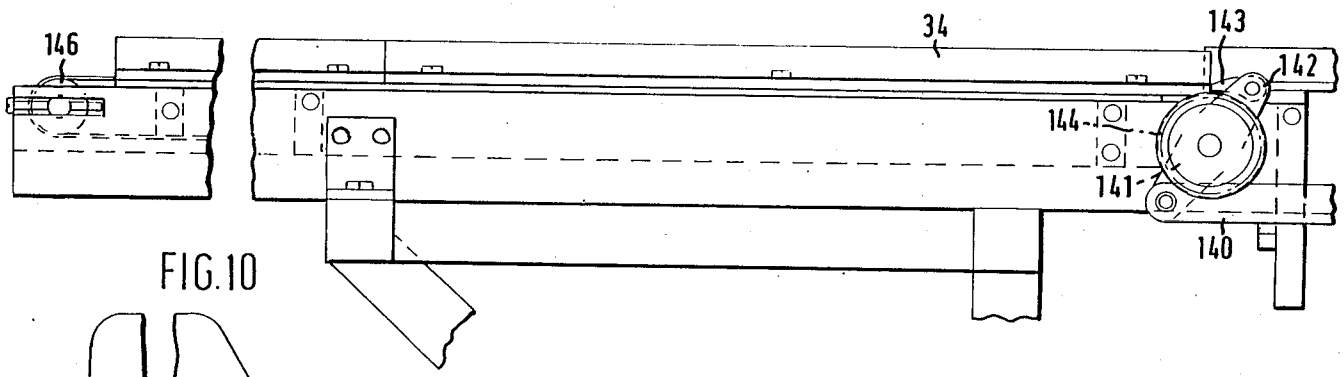
FIGS. 10 and 11 are side and plan views of an output conveyor that receives cut booklets from the cutting unit.
Figure 11:
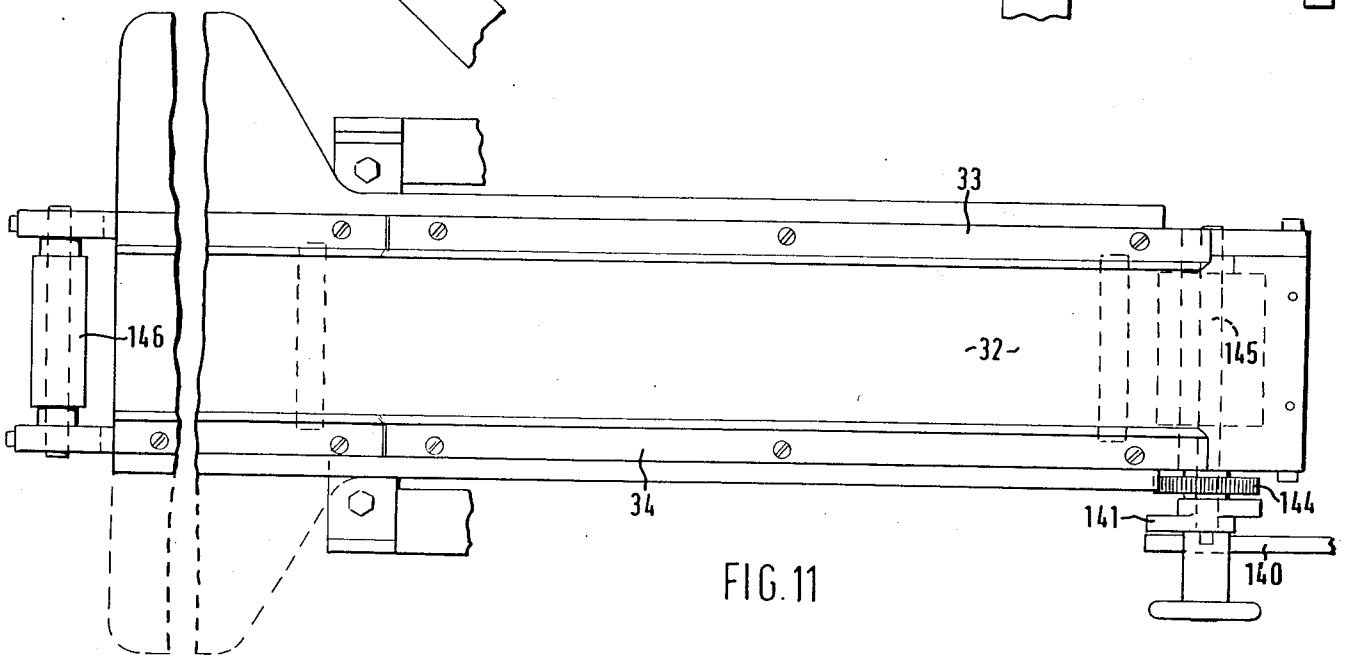

As more clearly seen in FIGS. 8, 9 and 10, the plates 27 and 28 carry four linear bearing carriers 70 that carry pairs of bearing rollers 71 directed at 90° that each run on a pair of adjacent faces of rectangular bearing bars 72. The location of the bearing carriers 70 can be adjusted to give an accurate alignment of the plates 27, 28. As shown in FIG. 5, the helical gear 57 on the transverse shaft 56 drives a helical drive gear 75 of a shaft 76 of hexagonal section that is supported in a fixed side plate 78 and in end plate 79 with its free end 80 projecting through the plate 79 to provide a drive for the belt conveyor described below. The shaft 76 passes through the plates 27, 28 and carries a sleeve 81 of hexagonal core profile and cylindrical external profile which is supported in ball bearings in side plates 27, 28. The sleeve 81 carries on the outer face of the plate 27 a cam 82 for operating the clamping mechanism that has a raised lobe 83 that occupies 180° of rotation. Between the plates 27, 28 there is attached to the sleeve 81 a cam 84 that operates the cutting knife. Finally on the outer face of the plate 28 there is attached to the sleeve 81 a third cam 85 that operates the pusher mechanism. It will be noted that the rise of cam 84 occupies only a small angle.

Figure 7:
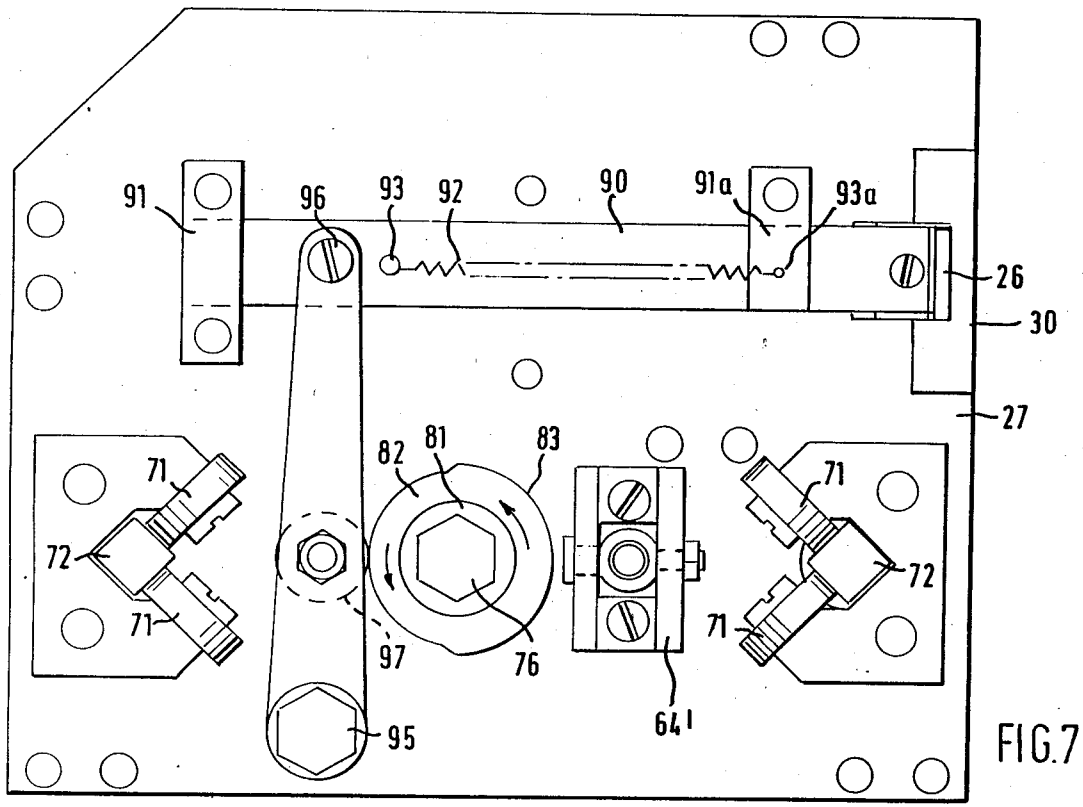
FIG. 7 is a view on the leading or upstream outer face of the cutting unit of FIG. 3 showing a clamping mechanism.

In FIG. 7, the clamping mechanism comprises a clamping bar 90 on the outer face of the leading plate 27 and guided for movement towards and away from the aperture 26 by means of straps 91, 91*a*. A tension spring 92 between a pin 93*a* on the strap 91*a* nearer the aperture 26 and a pin 93 on the bar 90 urges the clamping bar 90 towards clamping engagement with the interfolded strand of paper entering the aperture 26, and the bar 90 is lifted from clamping engagement therewith by a link 94 pivoted to the plate 27 and to the bar 90 at pivots 95, 96 and having a follower roller 97 engaged with the cam 82 so that the bar 90 is lifted from engagement with the advancing interfolded strand while the follower roller 97 is on the raised sector 83. As will be apparent from the earlier description, this is timed to be when the cutting unit 25 is in the return half of its travel.

In FIG. 8, the knife 29 is held against the inner face of plate 27 by means of upper and lower studs that locate in oval slots to permit the knife 29 to travel towards and away from the slot 26. An upper link 104 is pivoted between the knife 29 and plate 27 at pivots 105, 106. A lower link is pivoted at 108, 109 between the knife 29 and the plate 27, the pivots 108, 109 defining a link parallel to the link 104. The link 107 is connected to tension spring that returns the knife away from the aperture 26 and also carries a follower roller 111 that engages raised sector 112 on the cam 84 to advance the knife 29 across the aperture 26, thereby severing the strand of interfolded papers that have passed therethrough. The motion of the blade has components both towards and across the strand. This type of motion is referred to as a "guillotine-like" movement. It will be noted that the follower engages lobe 112 when follower 97 is free from sector 83 so that the cutting is timed to take place when the cutting unit is advancing with the interfolded paper strip clamped in position relative thereto.

The pusher mechanism which is on the outer face of the trailing plate 28 is shown in FIG. 9. The pusher 31 is carried by a bar 120 supported in straps 121, 122 for movement transversely of the interfolded paper strand and is urged away therefrom by tension spring between pin 124 on the bar 120 and pin 125 on the plate 28. An actuating lever 126 is pivoted to the plate 28 and 127 and to the bar 120 at 128 and carries a follower roller 129 that engages the cam 85. The roller 129 traverses lobe 130 on cam 85 to advance the pusher mechanism when the cutting unit 25 reaches the forward end of its travel, so that the cut strand is ejected onto the conveyor 32.

In order to drive the output conveyor 32 the free end 80 of the shaft 76 carries an eccentric pivoted to one end of link 140 whose oscillations are transmitted to one end of rachet lever 141 whose other end 142 carries a pawl 143 that engages a toothed drive wheel 144. The drive wheel 144 is connected to the shaft of a roller 145, which is one of a pair 145, 146 that support the endless belt conveyor 32. Thereby as the lever 141 is oscillated, the belt 32 is advanced stepwise in appropriate distance increments to accept cut booklets of interleaved paper.

Figure 12:
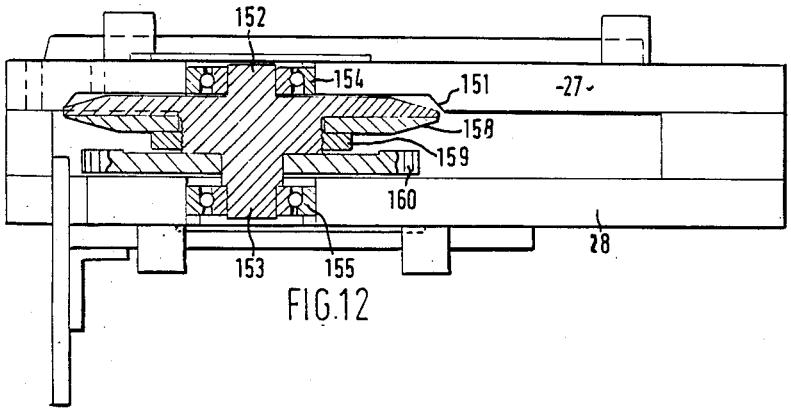
FIGS. 12 and 13 are views of an alternative cutting unit in plan and on the inner face of the leading plate respectively.
Figure 13:
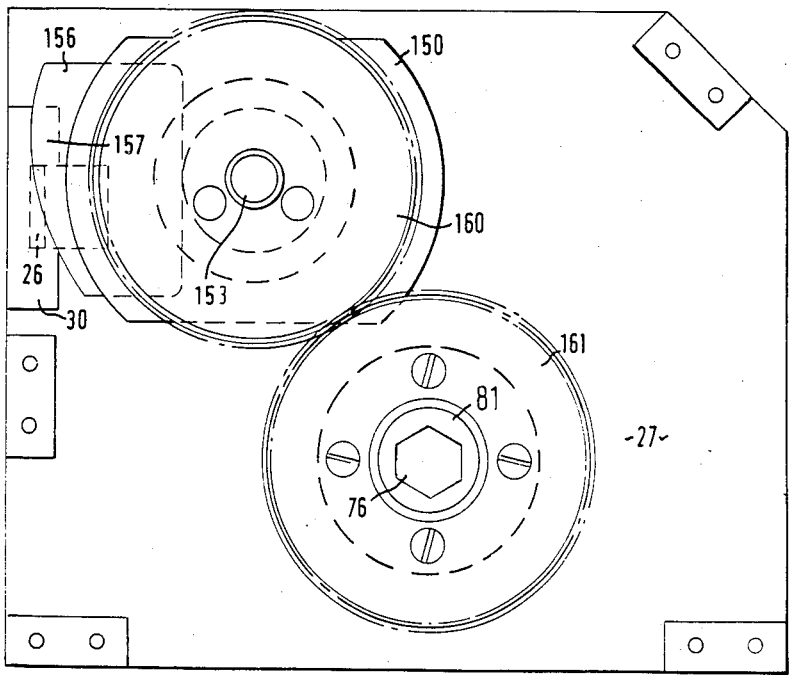

FIGS. 12 and 13 show an alternative embodiment of the cutting unit and take the place of FIG. 8 above. A knife support 150 rotates in recess 151 in the inner face of leading plate 27 and is supported for rotation between the plates 27, 28 by stub shafts 152, 153 that are supported in rolling contact bearings 154, 155. The support 150 rotatably carries a knife 156 having a generally crescent-shaped cutting blade 157 that traverses the aperture 26 once per rotation of the support. This type of motion is referred to as a "slicing" movement. The blade 157 not only compresses the paper strip during cutting but also moves across it, thereby giving a highly effective cutting action with reduced cutting force required. The knife 156 is held to the support 150 by means of a clamping disc 158 which is held in place by a nut 159. The support 150 is rotated by means of drive gear 160 that is rotated by driven gear 161 which is rotated by the hexagonal shaft 76. The timing of the knife traversal of the aperture 26 is as described with reference to FIG. 8. The arrangement described has the advantage that it gives a better cutting action, uses only rotating parts rather than reciprocating parts and is constructionally simpler than the arrangement of FIG. 8. Furthermore the blade 157 may be arranged to traverse a sharpening stone at each revolution so that it is maintained sharp in service and only has to be replaced at infrequent intervals.

It will be appreciated that various modifications may be made to the embodiments described above without departing from the invention, the scope of which is defined in the appended claims.

I claim:

1. A machine for forming booklets of paper comprising:

a plurality of roller means for continuously providing strips of paper;

former means for converging paper strips withdrawn from said roller means into a single strand;

means for advancing the strand in a first direction;

a cutting station for reciprocably moving along the strand whereby a booklet length of the strand enters said cutting station while said cutting station moves counter to the strand in a second direction opposite the first direction;

a knife means disposed in said cutting station for cutting a booklet from the strand while said cutting station moves alongside the strand in the first direction; and a driven shaft oriented normal to said first direction and having a constant velocity cam and a follower mounted thereon, said cutting station being connected by means of a pivoted link to said follower of said constant velocity cam;

a rotating shaft of non-circular cross-section extending through said cutting station parallel to said first direction and having a tubular sleeve slidably mounted thereon, said tubular sleeve being operably connected to said cutting station;

wherein reciprocal movement of said cutting station causes said tubular sleeve to slide in an axial direction along said rotating shaft; and wherein rotation of said rotating shaft causes said tubular sleeve to actuate said knife means.

2. A machine according to claim 1, further comprising:

a plurality of post means each having at least two slots at different heights, a single post means being disposed between pairs of adjacent roller means;

stub axles removably disposed through said roller means and into said slots for securing said roller means to said post means.

3. A machine according to claim 2, wherein said roller means are arranged in upper and lower rows, and further comprising:

guide rollers for deflecting paper strips received from said roller means to a generally horizontal line of travel and into said converging means.

4. A machine according to claim 3, wherein said converging means comprises a means for folding and interleaving paper strips in a zig-zag configuration.

5. A machine according to claim 4, wherein said means for folding and interleaving comprises:

a primary folding comb for folding paper strips, said primary folding comb being disposed adjacent said roller means;

a spreader comb for spreading apart strips of paper received from said primary folding comb;

a secondary folding comb that substantially defines an interfolded shape of paper strips received from said spreader comb;

and a final forming comb for determining a height of paper strips received from said secondary folding comb.

6. A machine according to claim 1, further comprising:

a conveyor belt means for transporting the booklets away from said cutting station; and a drive means for driving said conveyor belt.

7. A machine according to claim 6, wherein said drive means comprises:

an eccentric mounted on a free end of said rotating shaft;

a ratchet means operatively coupled to said eccentric; and a drive wheel responsive to said ratchet means for rotating said conveyor belt.

8. A machine according to claim 1, wherein said cutting station comprises a leading plate and a trailing plate fastened for movement together, and wherein said knife means is interposed between said plates.

9. A machine according to claim 8, further comprising support rollers for supporting said cutting station and a pair of spaced guide bars disposed in said first direction for bearingly guiding movement of said cutting station.

10. A machine according to claim 8, further comprising a strand clamping member disposed on said cutting station and;

a disengaging cam means disposed on said tubular sleeve for disengaging said clamping member when said cutting station is moving in said second direction.

11. A machine according to claim 10, further comprising an ejector means for ejecting cut booklets onto an outlet conveyor normal to said first direction; and an ejector cam disposed on said rotating shaft, operatively connected to said ejecting means, for activating said ejecting means.

12. A machine according to claim 1, further comprising:

a cam disposed on said tubular sleeve;

a cam follower operatively contacting said cam;

a parallel motion linkage means responsive to said cam follower for reciprocating said knife means across an aperture.

13. A machine according to claim 1, wherein said advancing means comprises a pair of rollers spring biased toward one another and adapted to receive the strand therebetween; and wherein one of said pair of rollers is driven.

14. A machine for forming booklets of paper comprising:

a plurality of roller means for continuously providing strips of paper;

forming means for converging paper strips withdrawn from said roller means into a single strand;

means for advancing the strand in a first direction;

a cutting station for reciprocably moving along the strand whereby a booklet length of the strand enters said cutting station while said cutting station moves counter to the strand in a second direction opposite the first direction;

a rotating shaft of non-circular cross-section extending through and operably connected to said cutting station parallel to said first direction;

a knife means responsive to rotation of said rotating shaft disposed in said cutting station for cutting a booklet from the strand while said cutting station moves alongside the strand in the first direction;

knife coupling means for translating rotational movement of said rotating shaft into rotational slicing movement of said knife means across the strand in a plane substantially perpendicular to said first direction;

an ejector means for ejecting booklets from said cutting station into an outlet passage;

ejector coupling means for coupling said ejector to said rotating shaft; and wherein said knife coupling means and said ejector coupling means cooperate with said rotating shaft so as to permit mutually independent movement of said knife means and said ejector means.

15. A machine according to claim 14, wherein said ejector coupling means comprises a linking means for translating rotational movement of said rotating shaft into longitudinal movement of said ejector means.

16. A machine according to claim 14, wherein said knife means has a generally crescent-shaped blade.

17. A machine for forming booklets of paper, comprising:

a plurality of roller means of continuously providing strips of paper;

former means for converging paper strips withdrawn from said roller means into a strand;

means for advancing the strand in a first direction;

a cutting station for reciprocably moving along the strand whereby a booklet length of the strand enters said cutting station while said cutting station moves counter to the strand in a second direction opposite to the first direction;

knife means disposed in said cutting station for cutting a booklet from the strand while said cutting station moves alongside the strand in the first direction;

outlet passage means normal to the first direction; and ejector means immediately adjacent to said knife means for ejecting booklets from said cutting station into said outlet passage means;

a rotating shaft of non-circular cross-section extending through said cutting station parallel to the first direction and having a tubular sleeve slideably mounted thereon, said tubular sleeve being operably connected to said cutting station;

wherein reciprocal movement of said cutting station causes said tubular sleeve to slide in an axial direction along said rotating shaft; and wherein rotation of said rotating shaft causes said tubular sleeve to actuate said knife means.

18. A machine for forming booklets of paper comprising:

a plurality of roller means for continuously providing strips of paper;

forming means for converging paper strips withdrawn from said roller means into a single strand;

means for advancing the strand in a first direction;

a cutting station for reciprocably moving along the strand whereby a booklet length of the strand enters said cutting station while said cutting station moves counter to the strand in a second direction opposite the first direction;

a rotating shaft of non-circular cross-section extending through and operably connected to said cutting station parallel to said first direction;

a knife means responsive to rotation of said rotating shaft disposed in said cutting station for cutting a booklet from the strand while said cutting station moves alongside the strand in the first direction;

an ejector means responsive to rotation of said rotating shaft for ejecting booklets from said cutting station into an outlet passage;

a connecting means for directing movement of each of said knife means and said ejector means comprising:

knife coupling means for coupling said knife means to said rotating shaft;

ejector coupling means for coupling said ejector to said rotating shaft;

wherein said knife coupling means and said ejector coupling means cooperate with said rotating shaft so as to permit mutually independent movement of said knife means and said ejector means in response to rotation of said rotating shaft.

19. A machine according to claim 18, further comprising a driven shaft oriented normal to said first direction and having a constant velocity cam and a follower mounted thereon;

wherein said cutting station is connected by means of a pivoted link to said follower of said constant velocity cam.

20. A machine according to claim 18, further comprising a tubular sleeve means slidably mounted on said rotating shaft for operably coupling said cutting station to said rotating shaft.

21. A machine according to claim 18, wherein said ejector coupling means comprises a linking means for translating rotational movement of said rotating shaft into longitudinal movement of said ejector means.

22. A machine according to claim 18, wherein said knife coupling means comprises a rotating cam means responsive to rotation of said shaft and a linking means for translating rotational movement of said rotating cam means into a reciprocal guillotine-like movement across the strand.

23. A machine according to claim 18, further comprising a clamp mean disposed in said cutting station for clamping the strand while said cutting station moves alongside the strand in the first direction; and wherein said connecting means further comprises a clamp coupling means for coupling said clamp means to said rotating shaft, said clamp coupling means permitting movement of said clamp means independent from movement of said knife means and said ejector means.

24. A machine according to claim 23, further comprising a means for disengaging said clamping means when said cutting station is moving opposite said first direction.

25. A machine according to claim 23, wherein said ejector coupling means comprises a first rotating cam means responsive to rotation of said rotating shaft and a first linking means for translating rotational movement of said first rotating cam means into longitudinal movement of said ejector means;

wherein said knife coupling means comprises a first gear means responsive to rotation of said rotating shaft and a second gear means for translating rotational movement of said first gear means into rotational slicing movement of said knife means across the strand in a plane substantially perpendicular to said first direction; and wherein said clamp coupling means comprises a third linking means for translating rotational movement of said rotating shaft into longitudinal movement of said clamp means.

26. A machine according to claim 18, wherein said rotating shaft is hexagonal in cross-section.

* * * * *